US012110758B2

(12) United States Patent
Yoshida et al.

(10) Patent No.: US 12,110,758 B2
(45) Date of Patent: Oct. 8, 2024

(54) DOWNHOLE TOOL SECURING DEVICE AND FRAC PLUG

(71) Applicant: Kureha Corporation, Tokyo (JP)

(72) Inventors: Shinnosuke Yoshida, Tokyo (JP); Shinya Takahashi, Tokyo (JP)

(73) Assignee: KUREHA CORPORATION, Tokyo (JP)

( * ) Notice: Subject to any disclaimer, the term of this patent is extended or adjusted under 35 U.S.C. 154(b) by 0 days.

(21) Appl. No.: 18/547,246

(22) PCT Filed: Feb. 24, 2022

(86) PCT No.: PCT/JP2022/007584
§ 371 (c)(1),
(2) Date: Aug. 21, 2023

(87) PCT Pub. No.: WO2022/181685
PCT Pub. Date: Sep. 1, 2022

(65) Prior Publication Data

US 2024/0052720 A1 Feb. 15, 2024

(30) Foreign Application Priority Data

Feb. 26, 2021 (JP) ..... 2021-031136

(51) Int. Cl.
*E21B 33/129* (2006.01)
*E21B 33/126* (2006.01)
*E21B 33/128* (2006.01)

(52) U.S. Cl.
CPC ..... *E21B 33/1285* (2013.01); *E21B 33/1265* (2013.01); *E21B 33/129* (2013.01)

(58) Field of Classification Search
CPC ..... E21B 33/0422; E21B 33/1265; E21B 33/129; E21B 33/134
See application file for complete search history.

(56) References Cited

U.S. PATENT DOCUMENTS 9,416,617 B2 8/2016 Wiese et al.
10,337,279 B2 7/2019 Frazier
(Continued)

FOREIGN PATENT DOCUMENTS

WO WO 2014/158336 A1 10/2014

OTHER PUBLICATIONS

International Preliminary Report on Patentability and English translation of the Written Opinion of the International Searching Authority for International Application No. PCT/JP2022/007584, dated Sep. 7, 2023.

(Continued)

*Primary Examiner* — Robert E Fuller
*Assistant Examiner* — Lamia Quaim
(74) *Attorney, Agent, or Firm* — Birch, Stewart, Kolasch & Birch, LLP

(57) ABSTRACT

A downhole tool securing device and a frac plug which are excellent in setting properties and water pressure resistance and have excellent fracturing properties. A downhole tool securing device (slips) of a frac plug according to one embodiment of the present invention includes a button containing a powder metallurgy material and having a compressive elastic modulus of at least 13.5 GPa and a toughness of 0.23 GJ/m$^3$ or greater and 1.0 GJ/m$^3$ or less.

5 Claims, 5 Drawing Sheets

(56) References Cited

U.S. PATENT DOCUMENTS

| | | | | |
|---|---|---|---|---|
| 10,415,335 | B2 | 9/2019 | Mhaskar et al. | |
| 2014/0224477 | A1* | 8/2014 | Wiese | E21B 33/1291 166/179 |
| 2014/0262327 | A1* | 9/2014 | Xu | B22F 3/12 166/376 |
| 2015/0368994 | A1 | 12/2015 | Mhaskar et al. | |
| 2017/0044859 | A1 | 2/2017 | Blair | |
| 2017/0234103 | A1 | 8/2017 | Frazier | |
| 2017/0314103 | A1 | 11/2017 | Roy et al. | |
| 2018/0128073 | A1 | 5/2018 | Frazier | |

OTHER PUBLICATIONS

European Search Report for European Application No. 22759720.0, dated Jun. 24, 2024.

* cited by examiner

DOWNHOLE TOOL SECURING DEVICE AND FRAC PLUG

TECHNICAL FIELD

The present invention relates to a downhole tool securing device and a frac plug.

BACKGROUND ART

In order to efficiently collect and recover hydrocarbon resources such as petroleum such as shale oil or natural gas such as shale gas, it is known to stimulate a production reservoir that produces these hydrocarbon resources by hydraulic fracturing. The hydraulic fracturing method is a method for generating pores, cracks (fractures), or the like in the production reservoir by a fluid pressure such as hydraulic pressure and efficiently collecting and recovering hydrocarbon resources through the fractures or the like. Between the ground surface and the production reservoir, a hole for forming a well called a downhole is provided. In the downhole, a vertical hole is drilled from the ground surface and subsequently bent to form a horizontal hole in the production reservoir located several thousand meters underground.

When the hydraulic fracturing method is applied to such a downhole, a downhole tool for closing a wellbore during hydraulic fracturing is installed in the downhole. In the installation, first, the downhole tool is sent to a predetermined position of the downhole. Then, while the downhole tool is operated to be secured to the wall of the downhole, an elastic member included in the downhole tool is deformed to close the downhole. Thereafter, water is pumped from the ground into the downhole to apply water pressure to an area closer to the ground than the previously closed position. In the production reservoir, pores are separately formed by using an explosive or the like, and cracks are generated from the pores by further applying water pressure.

The downhole tool, called a frac plug or the like, includes at least one mandrel and various members attached to the outer circumferential surface of the mandrel. On the outer circumferential surface of the mandrel, provided are a sealing member made of an elastic material and a securing device called a slip in order to ensure tight-securing to the wall of the downhole.

In addition, since the downhole tool is used to temporarily close the downhole, it is necessary to remove the downhole tool after use, and in order to facilitate the removal, development of a downhole tool having degradability has also been advanced.

Patent Document 1 discloses an embodiment in which a downhole tool is secured to a downhole by a cylindrical insert or button called a gripping element provided on a surface of a slip. It is disclosed that the gripping element is made of a powder metallurgy material in consideration of degradability, and is surface-hardened so that the surface layer has a Rockwell hardness of 55 to 62 HRC (or 40 to 80 HRC) and the core has a 15-N Rockwell hardness of 75 (about 30 in terms of HRC) or 70 to 97 (about 21 to more than 68 in terms of HRC).

Patent Document 2 also discloses a configuration in which an insert (button) is provided on a surface of a slip segment. It is disclosed that the insert is made of a powder metallurgy material and has sufficient strength and hardness to engage with the casing and secure the tool.

In addition, Patent Document 3 also discloses a configuration including an insert on a surface of a slip, and discloses that the insert can use a powder metallurgy material having a hardness of 50 to 60 Rc.

In addition, Patent Document 4 discloses a slip using a powder metallurgy material having a Rockwell C hardness of 55 to 60.

CITATION LIST

Patent Literature

Patent Document 1: US 2018/0128073
Patent Document 2: US 2014/0224477
Patent Document 3: US 2015/0368994
Patent Document 4: US 2017/0044859

SUMMARY OF INVENTION

Technical Problem

The button attached to the slip needs to be strong enough to withstand high water pressure, for example, up to 70 MPa, while being secured to the wall of the downhole (or a casing provided on the wall). On the other hand, considering that the downhole tool is degraded after the production reservoir is cracked as described above, the button also needs to have crushing properties.

Therefore, an object of one embodiment of the present invention is to realize a downhole tool securing device and a frac plug, which are excellent in securing properties, pressure resistance, and crushing properties.

Solution to Problem

In order to solve the above problems, a downhole tool securing device according to an embodiment of the present invention is a downhole tool securing device for securing a downhole tool to a casing in a well, the device including a main body; and a button attached to the main body and protruding from a surface of the main body, wherein the button includes a molded article of a powder metallurgy material, and the button has a compressive elastic modulus of at least 13.5 GPa and a toughness of 0.23 $GJ/m^3$ or greater and 1.0 $GJ/m^3$ or less.

In order to solve the above problems, a frac plug according to an embodiment of the present invention includes the downhole tool securing device described above.

Advantageous Effects of Invention

According to an embodiment of the present invention, it is possible to realize a downhole tool securing device and a frac plug, which are excellent in securing properties, pressure resistance, and crushing properties.

DESCRIPTION OF EMBODIMENTS

Hereinafter, an embodiment of a downhole tool securing device and a frac plug according to the present invention will be described with reference to FIGS. 1 to 3.

Figure 1:
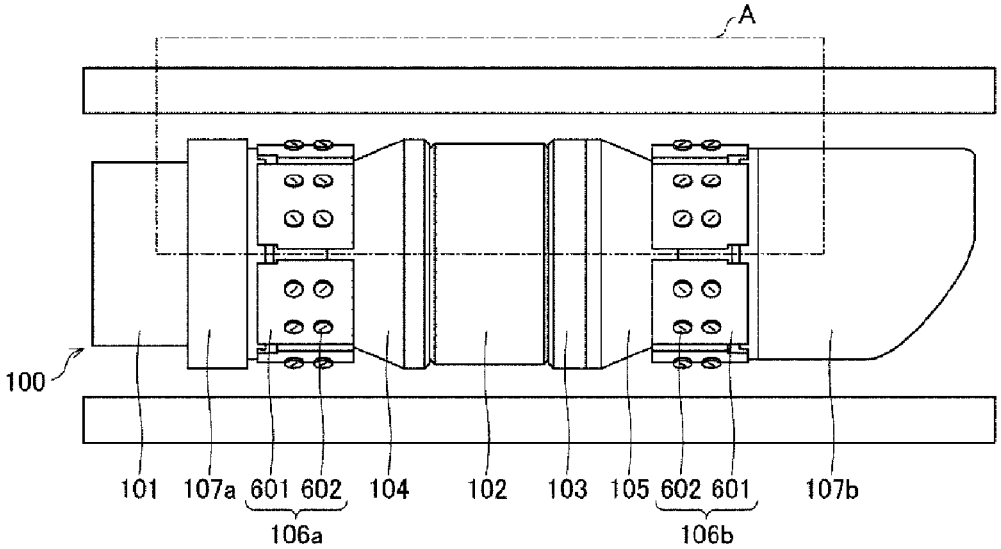
FIG. 1 is a side view of a frac plug including a downhole tool securing device according to an embodiment of the present invention.
Figure 4:
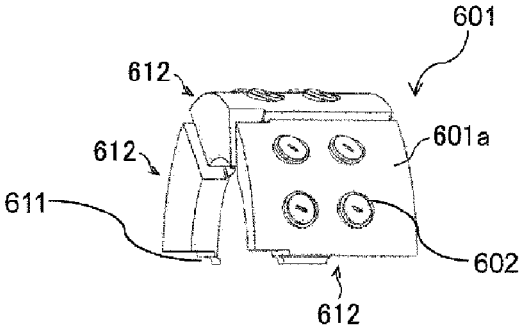
FIG. 4 is a partial perspective view of a slip base of a slip which is the downhole tool securing device according the embodiment of the present invention.
Figure 5:
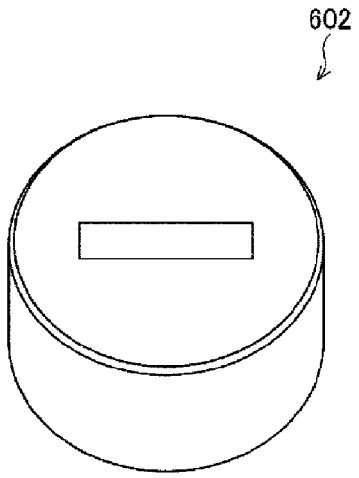
FIG. 5 is a partial perspective view of a button which is the downhole tool securing device according to the embodiment of the present invention.

FIG. 1 is a side view of a frac plug (downhole tool) of the present embodiment. FIG. 2 is a cross-sectional view for explaining a mechanism of the frac plug in FIG. 1. FIG. 3 is an enlarged cross-sectional view of a framed portion B illustrated in FIG. 2. FIG. 4 is a partial perspective view of a slip base of a slip which is a downhole tool securing device provided in the frac plug of the present embodiment. FIG. 5 is a partial perspective view of a button of the slip which is the downhole tool securing device provided in the frac plug of the present embodiment.

Frac Plug

As illustrated in FIG. 1, a frac plug 100 (downhole tool) of the present embodiment includes a mandrel 101, an elastic member 102, a holding member 103 disposed adjacently to the elastic member 102 on one side of the elastic member 102, cones 104, 105 disposed to sandwich the elastic member 102 and the holding member 103, a pair of slips 106*a*, 106*b* (downhole tool securing device), and a pair of ring members 107*a*, 107*b*.

Figure 2:
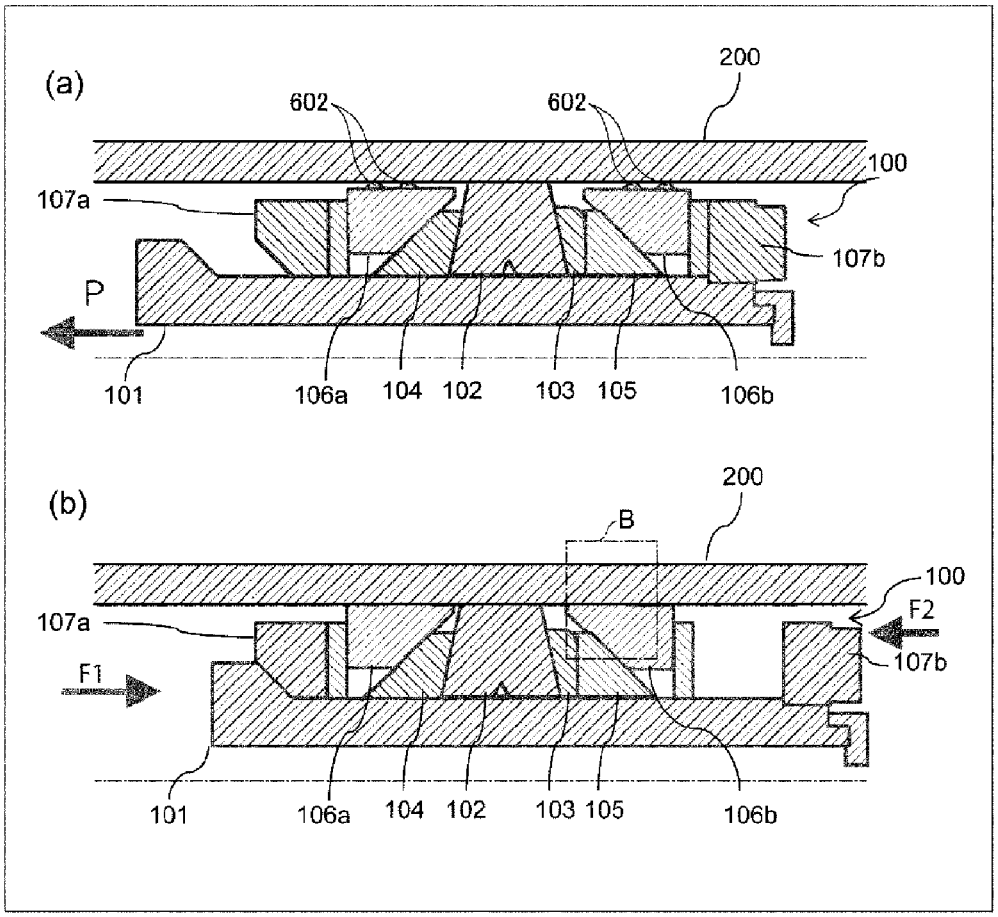
FIG. 2 is a partial cross-sectional view of the frac plug of FIG. 1.

In a wellbore (not illustrated), the frac plug 100 is installed in a casing 200 disposed within the wellbore, as illustrated in FIG. 2(*a*). When the frac plug 100 is installed in the casing 200, the mandrel 101 is moved in the axial direction indicated by P in FIG. 2(*a*) to reduce the distance between the pair of ring members 107*a*, 107*b* in the axial direction of the mandrel. This allows the slips 106*a*, 106*b* to ride on upper surfaces of the slopes of the cones 104, 105 and move outwardly orthogonally to the axial direction of the mandrel 101 to be in contact with the inner wall of the wellbore (the inner wall of the casing 200). As a result, the frac plug 100 is installed at a predetermined position of the wellbore. Here, in the slips 106*a*, 106*b*, a button 602 protrudes outwardly orthogonally to the axial direction of the mandrel 101 as described below. As a result, in a state where the slips 106*a*, 106*b* are in contact with the inner wall of the wellbore (the inner wall of the casing 200), a part of the button 602 is recessed into the inner wall of the casing 200. Thus, the frac plug 100 can be firmly secured to the inner wall of the wellbore.

As the mandrel 101 moves in the axial direction to reduce the gap between the cone 105 and the holding member 103, the elastic member 102 is deformed to expand outward in the outer circumferential direction of the axis of the mandrel 101. Then, the elastic member 102 is in contact with the casing 200, so that the space between the frac plug 100 and the casing 200 is closed.

After the frac plug 100 is installed at a predetermined position of the wellbore as described above, the wellbore is then closed by placing a ball or the like (not illustrated) in the axial hollow portion of the mandrel 101. Then, when a fluid is pumped into the closed section from the side of the cone 104 at high pressure in a state where the wellbore is closed, hydraulic fracturing is performed to create cracks in the production reservoir.

The frac plug 100 is removed from the well once hydraulic fracturing is completed. The frac plug 100 of the present embodiment is a degradable frac plug formed of a degradable material that is degradable by the fluid in the well. By being exposed to the fluid in the well (the fluid flowing in the axial direction of the mandrel, that is, in the direction of arrow F1 or F2 in FIG. 2(*b*)) for a predetermined time, the frac plug 100 is degraded, disintegrated, dissolved, and thus removed from its contact portion with the fluid, and the closed flow path is reopened. In order to realize this, it is preferable that each of the constituent members included in the frac plug 100 is formed of a degradable resin or degradable metal. This facilitates removal of the frac plug 100 after the well treatment using the frac plug 100.

In the present specification, the term "degradable resin or degradable metal" means a resin or metal which can be degraded or embrittled to be easily disintegrated, by biodegradation or hydrolysis, dissolution in water or hydrocarbons in a wellbore, or any chemical method. Examples of the degradable resin include aliphatic polyesters based on hydroxycarboxylic acid such as polylactic acid (PLA) and polyglycolic acid (PGA), lactone-based aliphatic polyesters such as poly-caprolactone (PCL), diol-dicarboxylic acid-based aliphatic polyesters such as polyethylene succinate and polybutylene succinate, copolymers thereof such as glycolic acid-lactic acid copolymers, mixtures thereof, and aliphatic polyesters using in combination aromatic components such as polyethylene adipate/terephthalate, or the like. Furthermore, a water-soluble resin may be used as the degradable resin. Examples of the water-soluble resin include polyvinyl alcohol, polyvinyl butyral, polyvinyl formal, polyacrylamide (which may be N, N-substituted), polyacrylic acid, and polymethacrylic acid, and furthermore copolymers of monomers forming these resins, such as ethylene-vinyl alcohol copolymer (EVOH) and acrylamide-acrylic acid-methacrylic acid interpolymer. Examples of the degradable metal include, for example, metal alloys containing magnesium, aluminum, and calcium as main components.

Slip 106*a*, 106*b* (Downhole Tool Securing Device)

Figure 3:
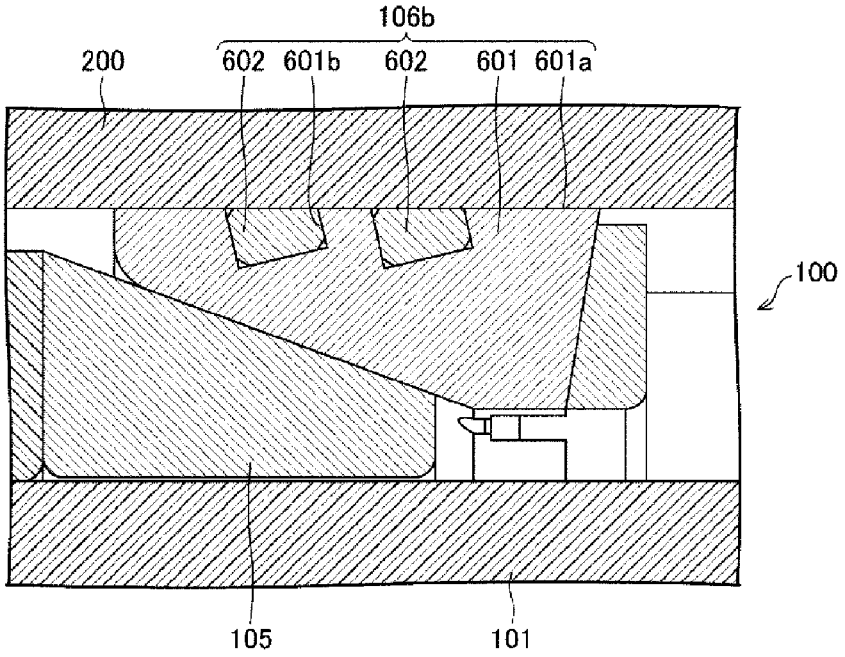
FIG. 3 is an enlarged cross-sectional view of a part of FIG. 1, and is a cross-sectional view illustrating a configuration of the downhole tool securing device according to the embodiment of the present invention.

FIG. 3 is an enlarged view of a portion B surrounded by a frame illustrated in FIG. 2(*b*), and illustrates a configuration of the slip 106*b*. Since the slip 106*a* has the same configuration as that of the slip 106*b* illustrated in FIG. 3, only the slip 106*b* will be described here.

As illustrated in FIG. 3, the slip 106*b* includes a slip base 601 (main body) and a button 602 attached to the slip base 601 and protruding from the surface of the slip base 601.

Slip Base 601 (Main Body)

The slip base 601 is a main body portion of the slip 106*b*, and slides on an inclined surface of the cone 105.

An outer circumferential surface 601*a* of the slip base 601 is provided with a recess 601*b* into which the button 602 is inserted. A plurality of buttons 602 are provided, and a number of recesses 601*b* are also formed in the outer circumferential surface 601*a* depending on the number of buttons 602.

One embodiment of the slip base 601 will be described with reference to FIG. 4. The slip base 601 includes a plurality of slip divided pieces 612 divided by a cut 611 which ends halfway from one end to the other end along the axial direction. Each of the slip divided pieces 612 is provided with a plurality of buttons 602 on the surface 601*a* that is in contact with the casing 200. The embodiment of the slip base 601 is not limited to the embodiment illustrated in FIG. 4.

The slip base 601 may be a degradable resin or degradable metal as described above, but is preferably formed of a reactive metal that is soluble in a predetermined solvent in the well.

The reactive metal is a metallic element that degrades by readily bonding with oxygen to form a very stable oxide, reacting with water to produce diatomic hydrogen, and/or readily absorbing oxygen, hydrogen, nitrogen, or another non-metallic element to become brittle. More specifically, the reactive metal means a an elemental metal or an alloy containing the metal element as a main component, which can be degraded by a degradation reaction based on a chemical change and thus easily deprive the original shape of the downhole tool or the downhole tool member under a predetermined condition (for example, conditions such as temperature and pressure, contact with a fluid such as an aqueous fluid (preferably an acidic fluid or the like), and the like) in a well environment (hereinafter, also called "downhole environment") in which the downhole tool is used.

The predetermined solvent refers to a fluid such as a fracturing fluid (that is, a well treatment fluid used for fracturing), and examples thereof include various additives such as a channelant, a gelling agent, a scale inhibitor, an acid for dissolving a rock or the like, and a friction reducing material, in addition to water.

A person skilled in the art can appropriately select the range of the reactive metal according to a predetermined condition such as an assumed well environment. In many cases, the reactive metal is an alkali metal or alkaline earth metal belonging to group I or group II of the periodic table, or aluminum or the like, but an alloy containing magnesium as a main component is preferable.

Button 602

As illustrated in FIG. 3, the button 602 is attached to the surface 601*a* of the slip base 601 that is in contact with the casing 200. FIG. 4 illustrates an embodiment in which four buttons 602 are provided in one slip divided piece 612, and the number of buttons 602 is not limited thereto. In addition, the number of buttons 602 provided with respect to the entire slip base 601 is not particularly limited.

As illustrated in FIG. 5, the button 602 is cylindrical. The button 602 is attached to the slip base 601 such that the central axis of the button 602 is inclined with respect to the axial direction of the mandrel 101 (FIGS. 1 and 2). The attachment method is not particularly limited, and a known method of attaching the button to the slip base can be employed.

The inclination angle of the central axis of the button 602 with respect to the axial direction of the mandrel 101 is, for example, 85° or less and preferably 80° or less, from the viewpoint of setting properties to a steel pipe. From the viewpoint of durability of the securing device, the inclination angle is 45° or greater and preferably 60° or greater. The button 602 may have a cylindrical shape with chamfered corners (edges).

The size of the button 602 can be set as appropriate, but as an example, an outer diameter of 9 mm and a thickness (height) of 5.9 mm can be used as in an example described below.

The button 602 includes a molded article of a powder metallurgy material and has a compressive elastic modulus of at least 13.5 GPa and a toughness of 0.23 GJ/m$^3$ or greater and 1.0 GJ/m$^3$ or less. The button 602 includes the molded article of the powder metallurgy material and has a compressive elastic modulus of at least 13.5 GPa and thus does not deform when being embedded in the casing 200 (FIGS. 1 and 2), and exhibits excellent setting properties (securing properties).

In addition, the button 602 includes a molded article of a powder metallurgy material and its toughness is 0.23 GJ/m$^3$ or greater and 1.0 GJ/m$^3$ or less, as described above. When the toughness is 0.23 GJ/m$^3$ or greater, the button has a strength sufficient to withstand high water pressure (for example, water pressure up to 70 MPa) during hydraulic fracturing of the production reservoir. On the other hand, since the toughness is 1.0 GJ/m$^3$ or less, excellent crushing properties are provided. As such, the button 602 can be easily removed when the frac plug 100 (FIG. 1) is removed from the well. As described above, since the removal is easy, the frac plug 100 does not remain in the well to become a failure (production failure) of the next treatment when removed from the well.

Preferably, the button 602 is formed of a molded article of a powder metallurgy material, and has an apparent density of 6.7 g/cm$^3$ or greater and 7.2 g/cm$^3$ or less. The button 602 can be formed of, for example, a molded article of an iron powder metallurgy material. As a result, its apparent density is smaller than the specific gravity of iron of 7.8, and the button 602 is easily broken. Therefore, it is unlikely to cause a production failure.

The button 602 includes a surface and a core, and the surface and the core each have a Rockwell hardness (HRC) of 20 or greater and 45 or less. Here, the surface of the button 602 is a portion corresponding to a surface of a cylindrical shape. A portion closer to the central portion than the surface is a portion corresponding to the core. Therefore, the surface and the core referred to herein are not separate parts from each other but represent a relative positional relationship in one molded article.

The HRC of the surface of the button 602 may be the same as or different from the HRC of the core. Further, the HRC of the core may be different between the surface side and the central portion of the button 602 (the central portion of a cylindrical body). For example, the HRC may be continuously varied from the surface side toward the central portion of the core. When the HRC is continuously different in the core, the "HRC of the core" as used herein refers to a value obtained by measuring the central portion of the core.

In addition, from the viewpoint of the setting properties and the water pressure resistance, the surface and the core of the button 602 each preferably have an HRC of 30 or greater.

As described above, the buttons 602 attached to the slips 106*a*, 106*b* of the present embodiment are excellent in the setting properties (securing properties) and water pressure resistance, and has excellent fracturing properties. Therefore, when the frac plug 100 (FIG. 1) is removed from the well, it can be easily removed and does not cause production failure.

Modified Example

As another embodiment of the frac plug according to the present invention, the frac plug may include a mandrel and an elastic member, and further include one slip and one corresponding cone and one corresponding ring member.

The present invention is not limited to the embodiments described above, and various modifications are possible within the scope indicated in the claims, which are also included in the technical scope of the present invention.

Further, the downhole tool securing device according to an embodiment of the present invention (slips 106*a*, 106*b* of the present embodiment) can also be applied to a downhole tool other than the frac plug 100, and the downhole tool is also included in the scope of the present invention.

SUMMARY

The downhole tool securing device (slips 106*a*, 106*b*) according to a first embodiment of the present invention is a downhole tool securing device for securing a downhole tool to a casing in a well, the device including a main body (slip base 601); and a button 602 attached to the main body and protruding from a surface 601*a* of the main body, wherein the button 602 includes a molded article of a powder metallurgy material, and the button 602 has a compressive elastic modulus of at least 13.5 GPa and a toughness of 0.23 GJ/m$^3$ or greater and 1.0 GJ/m$^3$ or less.

According to the configuration of the first embodiment, it is possible to realize a downhole tool securing device having excellent securing properties, pressure resistance, and crushing properties.

In a downhole tool securing device (slips 106*a*, 106*b*) according to a second embodiment of the present invention, in the first embodiment, the button 602 preferably has an apparent density of 6.7 g/cm$^3$ or greater and 7.2 g/cm$^3$ or less.

According to the configuration of the second embodiment, it is possible to realize a downhole tool securing device having excellent crushing properties.

In a downhole tool securing device (slips 106*a*, 106*b*) according to a third embodiment of the present invention, in the first or second embodiment, it is preferable that the button 602 includes a surface and a core, and the face and the core each have a Rockwell hardness (HRC) of 20 or greater and 45 or less.

According to the configuration of the third embodiment, when the button is embedded into an inner wall of the well (the inner wall of the casing), deformation can be suppressed and excellent securing properties can be exhibited.

In a downhole tool securing device (slips 106*a*, 106*b*) according to a fourth embodiment of the present invention, in the first to third embodiments, it is preferable that the main body is formed of a reactive metal that is soluble in a predetermined solvent, and the button includes a molded article of an iron powder metallurgy material.

The frac plug 100 according to a fifth embodiment of the present invention includes the above-described downhole tool securing device (slips 106*a*, 106*b*).

According to the configuration of the fifth embodiment, it is possible to realize a frac plug including a downhole tool securing device having excellent securing properties, pressure resistance, and crushing properties.

EXAMPLES

Hereinafter, the button attached to the slip of the present embodiment will be described using examples.

Production Method of Button

Example 1

The button 602 illustrated in FIG. 5 was produced by using a powder metallurgy material (1) having a composition shown in Table 1, adjusting a material input amount and a compression amount to set its density to a predetermined value, and surface-hardening the button by heat treatment.

Example 2

The button 602 illustrated in FIG. 5 was produced by using a powder metallurgy material (2) having a composition shown in Table 1, adjusting a material input amount and a compression amount to set its density to a predetermined value, and surface-hardening the button by heat treatment.

TABLE 1

| | Composition [%] | | | | | | | | |
|---|---|---|---|---|---|---|---|---|---|
| | Material | Fe | C | Cu | Mn | Mo | Ni | Cr | Others |
| Example 1 | Powder metallurgy material (1) | Remaining constituent | 0.1 to 0.5 | 1 to 3 | 0.05 to 0.45 | 0.2 to 0.6 | — | — | Less than 1 |
| Example 2 | Powder metallurgy material (2) | Remaining constituent | 0.2 to 0.6 | 1 to 3 | — | 0.2 to 0.7 | 3 to 5 | — | Less than 1 |

Comparative Examples 1 and 2

As a comparative example, an extruded material of tool steel (SKD11) was cut into a button shape and heat-treated to produce a button.

Comparative Example 3

A button was produced in the same manner as in Comparative Examples 1 and 2 except that an extruded material of structural alloy steel (SCM415) was used instead of the extruded material of the tool steel (SKD11), and the heat treatment condition was set to a condition for surface hardening. The compositions of the buttons of Comparative Examples 1 to 3 are summarized in Table 2.

TABLE 2

| | Composition [%] | | | | | | | | | | | |
|---|---|---|---|---|---|---|---|---|---|---|---|---|
| | Material | Fe | C | Si | Mn | P | S | Cr | Mo | V | Cu | Ni |
| Comparative Examples 1 and 2 | SKD11 | Remaining constituent | 1.4 to 1.6 | 0.15 to 0.35 | 0.3 to 0.6 | 0.025 or less | 0.010 or less | 11 to 13 | 0.8 to 1.2 | 0.2 to 0.5 | — | — |
| Comparative Example 3 | SCM415 | Remaining constituent | 0.12 to 0.18 | 0.15 to 0.35 | 0.55 to 0.95 | 0.030 or less | 0.030 or less | 0.85 to 1.25 | 0.15 to 0.3 | — | 0.3 or less | 0.25 or less |

Comparative Examples 4 and 5

As a comparative example, by using a powder metallurgy material (3) having a composition shown in Table 3, a material input amount and a compression amount were adjusted to set its density to a predetermined value, and a button that was surface-hardened by heat treatment was produced.

TABLE 3

| | Composition [%] | | | | | | | | |
|---|---|---|---|---|---|---|---|---|---|
| | Material | Fe | C | Cu | Mn | Mo | Ni | Cr | Others |
| Comparative Examples 4 and 5 | Powder metallurgy material (3) | Remaining constituent | 0.2 to 0.8 | 1 to 2 | — | 0.2 to 0.7 | 3 to 5 | — | Less than 1 |

Comparative Example 6

As a comparative example, a molded article of yttria-based zirconia (1) was used as a button.

Comparative Example 7

As a comparative example, a molded article of magnesia-based zirconia was used as a button.

Comparative Example 8

As a comparative example, a molded article of yttria-based zirconia (2) was used as a button.

The compositions of the buttons of Comparative Examples 6 to 8 are summarized in Table 4.

TABLE 4

| | Composition [%] | | | | | | | | | | | | | | | | |
|---|---|---|---|---|---|---|---|---|---|---|---|---|---|---|---|---|---|
| | Material | Fe | Cu | Mn | Mo | Ni | Al | Ca | Cr | Mg | Na | P | Si | Cl | Hf | O | Y | Zr |
| Comparative Example 6 | Yttria-based zirconia (1) | — | — | — | — | 0.04 | 0.20 | — | — | — | 0.20 | 0.01 | 0.01 | 0.20 | 1.2 | 36 | 3.7 | 59 |
| Comparative Example 7 | Magnesia-based zirconia | — | — | — | — | — | 0.20 | — | — | 1.7 | — | — | 0.1 | — | 1.4 | 35 | 0.1 | 62 |
| Comparative Example 8 | Yttria-based zirconia (2) | — | — | — | — | 0.1 | 0.1 | — | — | 0.1 | 0.30 | — | — | 0.20 | 1.5 | 32 | 4.0 | 62 |

(2) Measurement Method of Characteristics

Various characteristics of each button produced by the above-described production method were measured as follows.

Hardness Measurement

The hardness of the button surface was measured as follows. After an upper surface of the cylindrical button was polished and smoothed, an indenter of a micro Vickers hardness tester (Vickers hardness tester HV-114 available from Mitutoyo Corporation) was pressed against the button with a load 50 kgf at room temperature, and the hardness was calculated from a diagonal length of the indentation and a test load. As for the hardness of a core layer, the button was cut in a direction perpendicular to the axial direction of the cylindrical button, the cut surface was polished and smoothed, and then the hardness of the central portion of the cross section was measured in the same manner as for the surface hardness. With respect to the Rockwell hardness (HRC), the Vickers hardness obtained by the above method was converted in accordance with ASTM E140 Table 2.

Density Measurement (Apparent Density)

The weight of the button in air at 23° C. and the weight of the button in ion-exchanged water were measured, and the apparent density was calculated from the obtained weights and the density of the ion-exchanged water according to the Archimedes principle.

Compression Test

The cylindrical button was sandwiched between two tungsten carbide plates so that a bottom surface and an upper surface of the button were in contact with the tungsten carbide plates, and uniaxially compressed at a compression rate of 2 mm/min in the axial direction of the button at room temperature to obtain a strain-stress curve. The compressive elastic modulus was calculated in a section where the stress linearly changes over the strain. A crack was generated in the button with compression, and a point at which a maximum value was exhibited was defined as the compressive strength. The toughness was calculated by integrating the strain-stress curve in the section up to the strain at which the crack occurred.

Composition Analysis (Ceramic)

X-ray fluorescence (XRF) measurements were performed to determine the elemental composition of the ceramic buttons. Using a fundamental parameter (FP) method, the XRF peak intensity of each element was converted to a concentration ratio from the measurement results.

Set Test (Test of Setting Properties)

The frac plug 100 (FIG. 1) provided with the slips 106*a*, 106*b* was prepared. Polyglycolic acid (PGA) was used for the mandrel 101. Polyurethane was used for the elastic member 102. PGA was used for the holding member 103. PGA was used for the cone 104, a magnesium alloy was used for the cone 105, and in the pair of slips 106*a*, 106*b*, a magnesium alloy was used for the slip base 601 (FIG. 3) and the button described in "(1) Production method of button" was used for the button 602. PGA was used for the pair of ring members 107*a*, 107*b*.

After the above-described frac plug was disposed in the casing (steel pipe), a compressive load of 150 kN was applied to the members including the slips 106*a*, 106*b* disposed on the side surface of the mandrel 101 to bring the members including the slips 106*a*, 106*b* into contact with the casing (steel pipe). A case where the frac plug was secured to the steel pipe was evaluated as "Good", and a case where the frac plug was detached was evaluated as "Poor".

Water Pressure Resistance Test (Test of Water Pressure Resistance)

After the frac plug was secured to the steel pipe by the method described in section Set test, water was fed and sealed in the steel pipe while the steel pipe was heated to a temperature of 200 deg F. After sealing, water pressure of 10000 psi (about 70 MPa) was applied to the frac plug by a pump, and it was checked whether the frac plug was able to hold the water pressure for 30 minutes or longer. A sample was evaluated as "Good" when the frac plug held a water pressure for 30 minutes or longer, a sample was evaluated as "Margin" when the frac plug held a water pressure for 30 minutes or longer, and the frac plug was moved by 10 mm or greater after the application of the water pressure with respect to the position of the member including the slips 106*a*, 106*b* at the time of setting the frac plug in the steel pipe, and a sample was evaluated as "Poor" when the securing member was damaged and the water pressure can not be held for 30 minutes or longer.

Characteristics of Button

The characteristics of the buttons and the frac plugs of Examples 1 to 3 and Comparative Examples 1 to 8 described above are summarized in Table 5.

102 Elastic member

103 Holding member

104, 105 Cone

106*a*, 106*b* slip (downhole tool securing device)

200 Casing

601 Slip base (main body)

601*a* Outer circumferential surface (surface of main body)

601*b* Recess

602 Button

TABLE 5

| | Sample | | | | | | | | | Water | Compression test | | |
|---|---|---|---|---|---|---|---|---|---|---|---|---|---|
| | | Outer diameter | Thick-ness | Vickers hardness HV | | Rockwell HRC (converted value) | | Density | Set | pressure resistance | Elastic modulus | Compression strength | Toughness |
| | Material | [mm] | [mm] | Surface | Core | Surface | Core | [g/cm$^3$] | test | test | GPal | [GPa] | [GJ/m$^3$] |
| Comparative Example 1 | SKD11 | 9 | 5 | — | — | — | — | 7.7 | Good | Good | 19.6 | 5.4 or greater | 2.05 or greater |
| Comparative Example 2 | | | 5.9 | 656 | 701 | 58 | 60 | | Good | Good | 22.0 | 5.4 or greater | 2.07 or greater |
| Comparative Example 3 | SCM415 | | | 603 | 380 | 56 | 39 | 7.8 | Good | Good | 22.8 | 5.6 or greater | 2.03 or greater |
| Comparative Example 4 | Powder metallurgy material (3) (6.5) | | | 269 | 305 | 25 | 30 | 6.6 | Poor | Good | 12.5 | 1.8 | 0.28 |
| Comparative Example 5 | Powder metallurgy material (3) (6.9) | | | 321 | 374 | 32 | 38 | 7.0 | Poor | Good | 11.9 | 2.4 | 0.48 |
| Example 1 | Powder metallurgy material (1) | | | 383 | 373 | 39 | 38 | 6.9 | Good | Good | 15.0 | 2.4 | 0.44 |
| Example 2 | Powder metallurgy material (2) | | | 409 | 397 | 42 | 40 | 7.0 | Good | Good | 14.1 | 2.6 | 0.58 |
| Comparative Example 6 | Yttria-based zirconia (1) | 9.525 | 6.35 | 1311 | — | 91 | — | 6.0 | Good | Margin | 25.4 | 3.0 | 0.18 |
| Comparative Example 7 | Magnesia-based zirconia | 9 | 5.9 | 904 | — | 67 | — | 5.7 | Good | Poor | 24.2 | 1.9 | 0.08 |
| Comparative Example 8 | Yttria-based zirconia (2) | | 5.7 | 1231 | — | 84 | — | 6.0 | Good | Poor | 26.3 | 2.9 | 0.16 |

As shown in Table 5, it was shown that the buttons of Example 1 and Example 2 had good setting properties and water pressure resistance. On the other hand, all of Comparative Examples 4 to 8 were shown to have insufficient setting properties or water pressure resistance.

The buttons of Example 1 and Example 2 are powder metallurgy materials having a toughness in the range of 0.23 GJ/m$^3$ to 1.0 GJ/m$^3$ and an apparent density in the range of 6.7 g/cm$^3$ to 7.2 g/cm$^3$. The buttons of Examples 1 and 2 had excellent fracturing properties after hydraulic fracturing.

On the other hand, Comparative Examples 1 to 3 had a toughness exceeding 1.0 GJ/m$^3$, and thus it was shown that the crushing properties were not sufficient.

REFERENCE SIGNS LIST

101 Mandrel

100 Frac plug (downhole tool)

The invention claimed is:

1. A downhole tool securing device for securing a downhole tool to a casing in a well, the device comprising:

a main body; and a button attached to the main body and protruding from a surface of the main body, wherein the button includes a molded article of a powder metallurgy material, and the button has a compressive elastic modulus of at least 13.5 GPa and a toughness of 0.23 GJ/m$^3$ or greater and 1.0 GJ/m$^3$ or less.

2. The downhole tool securing device according to claim 1, wherein the button has an apparent density of 6.7 g/cm$^3$ or greater and 7.2 g/cm$^3$ or less.

3. The downhole tool securing device according to claim 1, wherein the button is formed of a surface and a core, and each of the surface and the core has a Rockwell hardness (HRC) of 20 or greater and 45 or less.

4. The downhole tool securing device according to claim 1, wherein the main body is formed of a reactive metal that is soluble in a predetermined solvent, and the button includes a molded article of an iron powder metallurgy material.

5. A frac plug comprising the downhole tool securing device described in claim 1.

* * * * *